United States Patent [19]

Miwa et al.

[11] Patent Number: 4,531,825

[45] Date of Patent: Jul. 30, 1985

[54] ELECTROSTATIC REPRODUCING APPARATUS HAVING AN INTERMEDIATE TONER IMAGE TRANSFER MEMBER

[75] Inventors: Tadashi Miwa, Kunitachi; Kiyoshi Kimura, Iruma; Yukio Okamoto; Noriyoshi Tarumi, both of Hachioji, all of Japan

[73] Assignee: Konishiroku Photo Industry Co., Ltd., Hino, Japan

[21] Appl. No.: 441,794

[22] Filed: Nov. 15, 1982

[30] Foreign Application Priority Data

Nov. 25, 1981 [JP] Japan ..... 56-187856
Nov. 25, 1981 [JP] Japan ..... 56-187857
Nov. 25, 1981 [JP] Japan ..... 56-187858

[51] Int. Cl.[3] ..... G03G 15/16
[52] U.S. Cl. ..... 355/3 TR; 355/16
[58] Field of Search ..... 355/3 TR, 3 R, 3 BE, 355/16, 3 TE

[56] References Cited

U.S. PATENT DOCUMENTS 4,195,927 4/1980 Fotland et al. ..... 355/3 TR

FOREIGN PATENT DOCUMENTS 107737 8/1979 Japan ..... 355/3 TR

*Primary Examiner*—Richard L. Moses
*Attorney, Agent, or Firm*—Jordan B. Bierman

[57] ABSTRACT

An electrostatic reproducing apparatus wherein a toner image formed on a toner image retaining member in the form of a belt is transferred to and fixed on a transfer material through an intermediate transfer member in the form of a roll. The intermediate transfer member is formed by providing a thin transfer layer on the outer periphery of a metal roll. The belt comprises an elastic material layer. A transfer pressure roller for pressing the back surface of the belt contacts with the intermediate transfer member, and the surface of the transfer pressure roll is covered with an elastic body.

9 Claims, 7 Drawing Figures

ELECTROSTATIC REPRODUCING APPARATUS HAVING AN INTERMEDIATE TONER IMAGE TRANSFER MEMBER

BACKGROUND OF THE INVENTION

1. Field of the Invention

The present invention relates to the improvement of an electrostatic reproducing apparatus wherein a toner image on a toner image retaining member is transferred onto an intermediate transfer member and then is further transferred therefrom onto a transfer material and fixed thereon.

2. Description of the Prior Art

As an example of the abovementioned electrostatic reproducing apparatus, an apparatus has been known to have a toner image retaining member of the drum type and an intermediate transfer member in the shape of an endless belt in close contact with the surface of the toner image retaining member, as described in Japanese Patent Publication No. 41,679/71, Patent Laid-Open No. 78,559/74, Patent Laid-Open No. 100,582/80, etc. Such an apparatus facilitates obtaining reproduced images of high quality, by a retention method wherein a plurality of the same reproduced images are obtained by forming a latent image once on the toner image retaining member and by repeating the development and transfer thereof, to make the speed of reproduction higher. In addition, has also the advantage that transfer and fixation can be made on ordinary paper even when one-component conductive toner is used as the developing toner and thereby simplification of the developing system and improvement of the quality of image, etc. can be attained. There is a problem in such an apparatus, however, that at least two rotating rolls are required to drive the belt of the intermediate transfer member and this prevents reduction of the size and weight of the reproducing apparatus.

Meanwhile, as an electrostatic reproducing apparatus in which a reduction in size and weight is achieved, an apparatus is also known which uses an intermediate transfer member formed as a roll, as described in Japanese Patent Application No. 41,679/71, Patent Publication No. 4,848/72, Utility Model Laid-Open No. 7,945/81, etc. To enable a further reduction of size and weight of the apparatus, in particular, a heat source for fixing the toner image on the transfer material is provided inside the roll-shaped intermediate transfer member. Since the toner image on the toner image retaining member needs to be transferred surely onto the intermediate transfer member in the apparatus, the roll-shaped intermediate transfer member is further provided with its elastic material layer under a surface transfer-body layer so that the contact of the surface of the toner image retaining member with the surface of the intermediate transfer member is uniformly throughout the whole width and under uniform pressure. When the intermediate transfer member is provided with the elastic material layer in this way, warming up time from the start of heating to the readiness for transfer and fixation becomes longer even with the heat source provided inside the intermediate transfer member. So as to reduce the warming up time, it is necessary to reduce the thickness of a metal roll forming the core of the intermediate transfer member as much as possible within a range wherein no deformation thereof is caused by the pressure for transfer and, further, to make the elastic material layer of the transfer member also as thin as possible.

And yet it is rather difficult to shorten the warming up time, since a transfer-body layer for improving the transference of the toner image, formed of silicone or fluoride resin 500 of μm thick, is usually provided on the surface of the intermediate transfer member so as to ensure the transference of the toner image from the toner image retaining member. That is, it is extremely difficult in practice to realize an electrostatic reproducing apparatus wherein a reduction of size and weight of the apparatus is achieved, transfer and fixation of the toner image are conducted surely and stably, and curtailment of the warming up time is performed in combination with the intermediate transfer member and the toner image retaining member whose surface must not allow elastic deformation.

SUMMARY OF THE INVENTION

The purpose of the present invention is to offer an electrostatic reproducing apparatus enabling a solution to the aforesaid difficulty. The present invention is characterized in that the aforesaid toner image retaining member is formed in a belt having an elastic material layer and the intermediate transfer member is formed as a roll, and the toner image formed on the toner image retaining member is transferred onto the intermediate transfer member and is further transferred therefrom onto the transfer material and fixed thereon.

An electrostatic reproducing apparatus in another embodiment of the present invention is characterized in that the toner image retaining member is formed as a belt, and a pressing roll whose surface is covered with an elastic body presses the back surface of said belt to make the toner image retaining member contact under pressure with the intermediate transfer member. The characteristics of the present invention enable realization of an electrostatic reproducing apparatus wherein it becomes unnecessary to provide an elastic material layer on the intermediate transfer member, and in which a reduction of size and weight can be achieved and the warming up time is shortened.

An electrostatic reproducing apparatus in still another embodiment of the present invention has the toner image retaining member formed in the shape of a drum having an elastic material surface layer enabling elastic deformation by pressing, and the intermediate transfer member formed as a roll is pressed on the toner image retaining member and thereby the transfer of the toner image is conducted. That is, the present invention enables the achievement of such purposes as reduction of size and weight of the electrostatic reproducing apparatus, the stable and ensured transfer and fixation of the toner image and, further, the curtailment of warming up time, etc. by the abovementioned constitution.

Other purposes and characteristics of the present invention are to be made clear hereunder with the description of the drawings.

DESCRIPTION OF THE PREFERRED EMBODIMENTS

Figure 1:
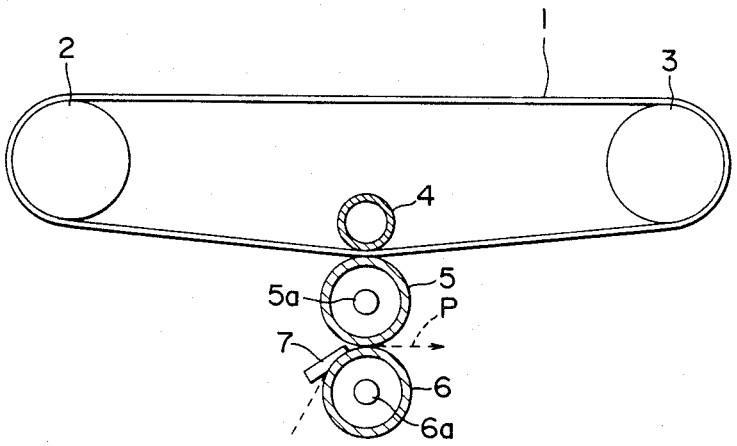
FIG. 1 is a sectional view showing one example of a reproducing apparatus offered by the present invention.

In the electrostatic reproducing apparatus in FIG. 1, a belt-shaped toner image retaining member 1 is moved round by a driving roll 2 and a tension roll 3 which rotate clockwise and is pressed on a roll-shaped intermediate transfer member 5 by a transferring-pressing roll 4 which rotates also clockwise. Along the rotating passage of the toner image retaining member 1, a cleaning mechanism, an electrostatic latent image forming mechanism, a toner developing mechanism, etc., which are not shown in the drawings, are provided in the same way as in conventional electrostatic reproducing apparatuses. After the surface of the toner image retaining member 1 is cleaned by the cleaning mechanism, an electrostic latent image is formed thereon, and a toner image is developed thereon by the toner developing mechanism and transferred onto the intermediate transfer member 5 by the transferring-pressing roll 4. The intermediate transfer member 5, whose surface speed is equal to that of the toner image retaining member 1, rotates counter-clockwise, transferring the toner image transferred thereon onto a transfer material P fed by the intermediate transfer member 5 and a fixing-pressing roll 6 rotating clockwise at a speed equal to that of the former, which hold with pressure the material P between them. The toner image transferred on the transfer material P is fixed thereon through the melting of toner by the heat of heating board 7, by the heat from heat source 5*a* in the intermediate transfer member 5, and further by the heat from heat source 6*a* built in the fixing-pressing roll 6.

Figure 2:
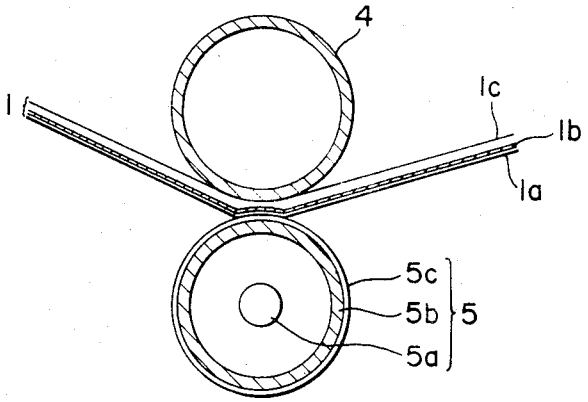
FIG. 2 is a partial enlarged sectional view of FIG. 1.

In this constitution, the toner image retaining member 1, as shown in FIG. 2, is composed of a structure having a photosensitive body layer 1*a* formed of OPC, selenium, amorphous silicon or the like at the front surface, a metal layer 1*b* formed of a sheet of nickel steel, stainless steel or the like or of an evaporation layer of aluminum or the like in the middle, which prevents elongation of a member or the rise in temperature through radiation of heat and can also serve as an electrode, and an elastic material layer 1*c* formed of silicone rubber, ethylene-propylene rubber, sponge or the like at the back surface.

In addition, it is preferable that the elastic material layer 1*c* is made to contain electroconductive powder such as carbon black and metal powder to be an electroconductive layer and thereby to make it easy for grounding or the application of voltage thereon, etc. The intermediate transfer member 5 is composed of a structure wherein the heat source 5*a* such as a halogen heater is provided inside a metal roll 5*b* formed of aluminum, stainless steel, iron or the like on the surface of which a transfer-body layer 5*c* is formed of heat-resisting resin of silicon, fluoride or the like. The toner image retaining member 1 and the intermediate transfer member 5 are made to closely contact each other with uniform pressure throughout the whole width thereof by the elastic material layer 1*c* of the toner image retaining member 1, as seen in FIG. 2. The transfer of a toner image from the toner image retaining member 1 to the intermediate transfer member 5 is surely conducted. The intermediate transfer member 5 can be made with a thin transfer-body layer 5*c* on the surface of the metal roll 5*b* forming the core, wherein the heat of the heat source 5*a* can easily propagate to the surface. Accordingly, as mentioned above, the toner image can be transferred from the intermediate transfer member 5 to the transfer material P and fixed thereon after a very short warming up time from the start of heating by the heat source 5*a*. For the transfer-body layer 5*c*, a rubber or resin of silicon or fluoride is preferred.

Figure 3:
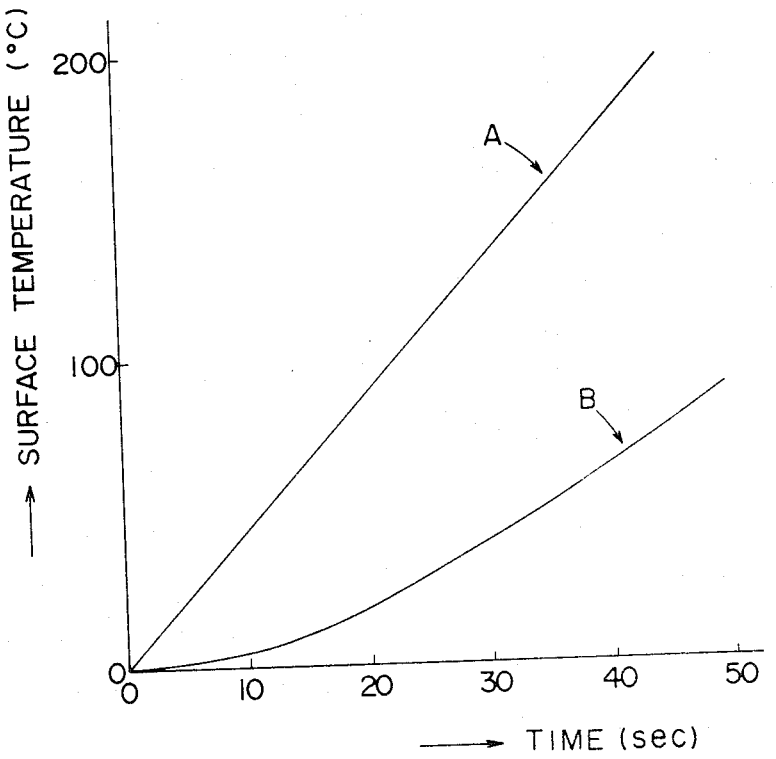
FIG. 3 is a graph showing a rising curve of the surface temperature of a roll-shaped intermediate transfer member.

Line A is FIG. 3 in a rising curve of the surface temperature by the heat source 5*a* of the intermediate transfer member 5 shown in FIG. 2 whose metal roll 5*b* is formed of stainless steel with its cylindrical part having an outside diameter of 30 mm and a wall thickness of 1 mm , whose heat source 5*a* is a halogen heater of 800 watt and whose transfer-body layer 5*c* is formed of fluoride resin 200 μm thick. Line B in the same figure is a rising curve of the surface temperature by the aforesaid heat source 5*a* of an intermediate transfer member which is provided with an elastic material layer formed of silicone rubber 2 mm thick in addition to the aforesaid transfer-body layer 5*c* and is equivalent to the conventional roll-shaped intermediate transfer members. While the surface temperature does not reach 100° C. even after the passage of 50 seconds from the start of heating in the conventional roll-shaped intermediate transfer members, it exceeds 100° C. in the intermediate transfer member fully enough, in 30 seconds from the start of heating, to fix completely the toner image on the transfer material P from the belt-shaped toner image retaining member 1 provided with the elastic material layer on the back-surface side of the belt-shaped member.

Moreover, the belt-shaped toner image retaining member 1 can be stretched in suspension not only in the form of a horizontal stretch as shown in FIG. 1, but also in various other forms by using tension rolls accordingly. Therefore, it does not cause any more hindrance than conventional drum-shaped toner image retaining members in terms of reduction of size and weight of the electrostatic reproducing apparatus. Accordingly, the advantage of a roll-shaped intermediate transfer member for reduction of size and weight is not lost.

As aforesaid, the present invention enables realization of an electrostatic reproducing apparatus of which a reduction of size and weight can be achieved, by which transfer and fixation of the toner image are conducted surely and stably and in which the warming up time for heating for fixation is extremely short.

In addition, the present invention is not only embodied in the example shown in FIGS. 1 and 2 but also may be embodied, for instance, in an apparatus wherein no heat source is built into the fixing-pressing roll or wherein a transfer material heating board is omitted. Furthermore, while the transfer of the toner image onto the intermediate transfer member is obtained through adhesion by pressure in the embodiment described, it is also possible to use the present invention for electrostatic transfer by applying a voltage beween the retaining member and the intermediate transfer member.

Figure 4:
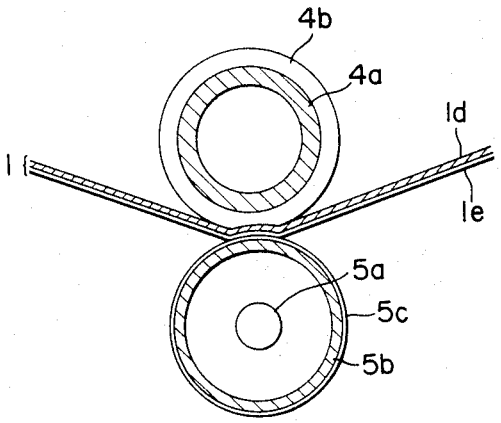
FIG. 4 and FIG. 5 are explanatory views of a transferring-pressing roll in another embodiment of the present invention.

In another embodiment of the electrostatic reproducing apparatus offered by the present invention, as shown in FIG. 4, the transferring-pressing roll 4 has a constitution wherein an elastic body layer 4*b* made of material such as rubber or sponge of silicon or fluoride is provided on the outer periphery of a roll core 4*a* made of rigid material such as aluminum, stainless steel, iron or hard resin. Accordingly, when the back surface of the belt-shaped toner image retaining member 1 is pressed by the transferring-pressing roll 4 to press the toner image retaining member 1 on the intermediate transfer member 5, the elastic body layer 4*b* of the transferring-pressing roll 4 is deformed elastically as seen in FIG. 4. Thus the contact is made uniformly in such a way that the toner image retaining member 1 contact closely and properly with the surface of the roll of the intermediate transfer member 5 under uniform pressure throughout the whole width thereof. Therefore, the transfer of the toner image from the toner image retaining member 1 onto the intermediate transfer member 5 is ensured.

Figure 5:
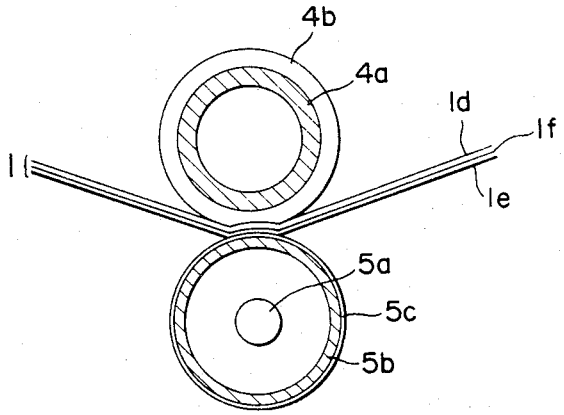

The toner image retaining member 1 in FIG. 4 has a constitution wherein a photosensitive-body surface layer 1*e* formed of OPC, selenium, amorphous silicon or the like is provided on a base body 1*d* formed of a metal sheet 30 μm–500 μm thick which is made of nickel steel, stainless steel or the like and which prevents elongation of the member, radiates the heat thereof and also serves as an electrode. The toner image retaining member 1 in FIG. 5 has a constitution wherein an intermediate layer 1*f* formed of an evaporation layer of aluminum or the like which radiates the heat and also serves as an electrode is provided between the base body 1*d* formed of a resin sheet of polyimide, PET or the like and the photosensitive-body surface layer 1*e* of OPC, selenium, amorphous silicon or the like.

Figure 6:
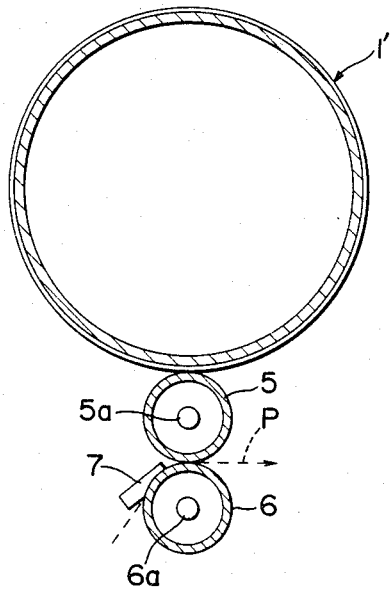
FIG. 6 is a sectional view of an electrostatic reproducing apparatus in still another embodiment of the present invention.

In still another embodiment of the electrostatic reproducing apparatus offered by the present invention, the toner image retaining member 1' is formed in the shape of a drum as shown in FIG. 6.

Figure 7:
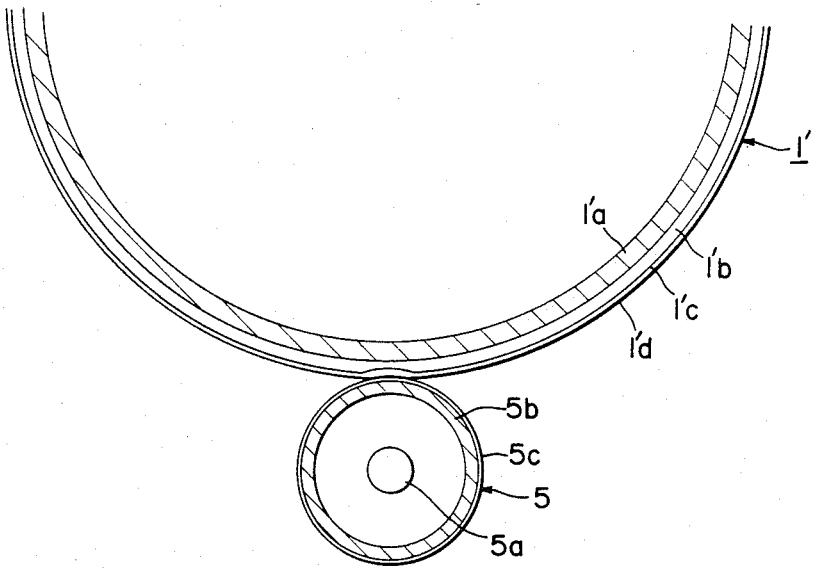
FIG. 7 is an enlarged sectional view of a part of the apparatus.

As shown in FIG. 7, the drum-shaped toner image retaining member 1' is constituted by providing an elastic material layer 1'*b* of silicone rubber, ethylene-propylene rubber or sponge on the peripheral surface of a drum base body 1'*a* formed of metal such as aluminum, stainless steel, iron or the like or of hard resin such as polyester, polycarbonate, polyamide or the like. Also a thin metal layer 1'*c* is formed of a metal sheet of nickel, stainless steel or the like or of a metal evaporation layer of aluminum or the like on the elastic material layer 1'*b*. A photosensitive-body surface layer 1'*d* is of OPC, selenium, amorphous silicon or the like on the thin metal layer 1'*c*.

It is preferable that the elastic material layer 1'*b* is made to contain electroconductive powder such as carbon black, metal powder or the like to be an electroconductive layer so as to make it easy for grounding or applying of voltage thereon. By the toner image retaining member 1' being provided with the elastic material layer 1'*b* in this way, the photosensitive-body surface layer 1'*d* of the toner image retaining member 1' is deformed elastically in the pressure contact of the toner image retaining member 1 with the intermediate transfer member 5 in such a manner that its surface retaining the toner image contacts closely and fully with the surface of the intermediate transfer member 5 as seen in FIG. 7. Thereby the pressure contact of the two surfaces is made uniform under the uniform pressure applied throughout the whole width thereof. The transfer of the toner image from the toner image retaining member 1' onto the intermediate transfer member 5 is thereby ensured. In addition, by the surface of the toner image retaining member 1' being deformed elastically, the intermediate transfer member 5 can be constituted as aforesaid and, accordingly, the surface temperature of the transfer member 5 can be raised higher than the fusion temperature of the toner in a very short time by the heat of the heat source 5*a*, whereby the toner image can be transferred onto the transfer material and fixed thereon easily and surely.

What is claimed is:

1. In an electrostatic reproducing apparatus wherein a toner image formed on a toner image retaining member is transferred onto an intermediate transfer member and the toner image on said intermediate transfer member is transferred to and fixed on a transfer material, the improvement comprising the aforesaid toner image retaining member being formed in a belt, and further comprising a transfer pressure roller for pressing the back surface of the belt such that its front toner image retaining surface contacts said intermediate transfer member, wherein the surface of said transfer pressure roller is covered with an elastic body which is deformable in the pressing contact of the belt against said intermediate transfer member, the latter being relatively nondeformable and having a low heat capacity.

2. The electrostatic reproducing apparatus according to claim 1, wherein the aforesaid intermediate transfer member is formed by providing a thin transfer layer on the outer periphery of a metal roll.

3. The electrostatic reproducing apparatus according to claim 1, wherein said intermediate transfer member is formed by a layer of a rubber or a resin consisting essentially of silicon polymer or fluoride polymer having the thickness of 1 mm or less on the outer periphery of a metal roll.

4. In an electrostatic reproducing apparatus wherein a toner image formed on a toner image retaining member is transferred onto an intermediate transfer member and the toner image on said intermediate transfer member is transferred to and fixed on a transfer material, the improvement comprising the aforesaid toner image retaining member being formed in a belt, and a transfer roller for pressing the back surface of the belt such that the front toner image retaining surface of said belt contacts said intermediate transfer member, wherein said belt comprises an elastic material layer which is deformable in the pressing contact of said transfer pressure roller on said belt against said intermediate transfer member.

5. The electrostatic reproducing apparatus according to claim 4, wherein said belt further comprises a photoconductive layer and a metal layer.

6. In the electrostatic reproducing apparatus wherein the toner image formed on the toner image retaining member is transferred onto the intermediate transfer member and the toner image on said intermediate transfer member is transferred to and fixed on the transfer material, the improvement characterized in that the aforesaid toner image retaining member is formed in a drum having an elastic material layer which makes the peripheral surface of the toner image retaining member deformable elastically by pressing and in that the aforesaid intermediate transfer member is formed in a roll.

7. The electrostatic reproducing apparatus according to claim 6, wherein the aforesaid intermediate transfer member is formed by providing a layer of rubber or resin of silicon or fluoride having the thickness of 1 mm or less on the outer periphery of a metal roll.

8. In an electrostatic reproducing apparatus wherein a toner image formed on a toner image retaining member is transferred onto an intermediate transfer member and the toner image on said intermediate transfer member is transferred to and fixed on a transfer material, the improvement comprising the aforesaid toner image retaining member being formed in a belt, and further comprising a transfer pressure roller for pressing the back surface of the belt such that its front toner image retaining surface contacts said intermediate transfer member, said intermediate transfer member being formed of a thin transfer layer on the outer periphery of a metal roll, said transfer pressure roller being covered with an elastic body which is deformable in the pressing contact of the belt against said intermediate transfer member, and heating means for heating the toner on the intermediate transfer member.

9. The improved electrostatic reproducing apparatus of claim 8, wherein said heating means comprises a heating source arranged within the intermediate transfer roll.

* * * * *